US007547856B2

(12) United States Patent
Tan

(10) Patent No.: US 7,547,856 B2
(45) **Date of Patent: *Jun. 16, 2009**

(54) SEALED PUSHBUTTON SWITCH

(75) Inventor: Jun-Ming Tan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 78 days.

This patent is subject to a terminal disclaimer.

(21) Appl. No.: 11/803,574

(22) Filed: May 14, 2007

(65) Prior Publication Data

US 2007/0261945 A1 Nov. 15, 2007

(30) Foreign Application Priority Data

May 12, 2006 (TW) ..... 95208118 U

(51) Int. Cl.
*H01H 5/18* (2006.01)

(52) U.S. Cl. ..... 200/406; 200/302.2

(58) Field of Classification Search ..... 200/16 R–16 D, 200/520, 530, 532, 536, 302.1, 302.2, 329, 200/341, 61.58 R, 61.62, 61.71–61.76
See application file for complete search history.

(56) References Cited

U.S. PATENT DOCUMENTS

| | | | | |
|---|---|---|---|---|
| 5,900,600 | A * | 5/1999 | Alexander et al. | 200/43.14 |
| 6,096,986 | A * | 8/2000 | Flegel | 200/50.33 |
| 6,452,470 | B1 * | 9/2002 | Malingowski et al. | 335/202 |
| 6,459,057 | B1 | 10/2002 | Domzalski | |
| 6,545,234 | B1 * | 4/2003 | Trivette et al. | 200/50.21 |
| 6,743,987 | B1 * | 6/2004 | Remmert et al. | 200/50.33 |
| 7,329,821 | B2 * | 2/2008 | Tan | 200/302.2 |

* cited by examiner

*Primary Examiner*—Michael A Friedhofer
*Assistant Examiner*—Lisa N Klaus
(74) *Attorney, Agent, or Firm*—Wei Te Chung

(57) ABSTRACT

A sealed pushbutton switch (1) includes an insulative housing (2) defining a cavity (25), an actuator (3) movably retained in the insulative housing, a base (8) conglutinated to the insulative housing by glue, a number of fixed contacts (7) assembled to the base, a spring (5) mounted below the actuator, and a movable contact (6) mounted on the actuator and provided with a number of contact portions (621) in contact with corresponding fixed contacts. The movable contact is movable with the actuator from a first position to a second position relative to the insulative housing along a top-to-bottom direction to disengage the fixed contacts. The base has four slots (811) defined near four sides thereof.

16 Claims, 6 Drawing Sheets

SEALED PUSHBUTTON SWITCH

BACKGROUND OF THE INVENTION

1. Field of the invention

The present invention relates to a sealed pushbutton switch, and particularly to a normally closed sealed pushbutton switch used in various electronic appliance.

2. Description of Related Art

A conventional sealed pushbutton switch is described in U.S. Pat. No. 6,459,057, which was issued on Oct. 1, 2002. The pushbutton switch is normally in a closed position, comprising a base, a plurality of fixed contacts assembled to the base, an insulative housing snapping onto the base, an actuator retained in the insulative housing and provided with a shaft and a head, a contact spring normally in contact with an inner edge of fixed contacts for establishing an electrical connection between the fixed contacts, a coil compression spring abutting against a bottom of the head, and an O-ring mounted around the shaft. In operation, the actuator is pushed downwardly to thereby move the contact spring away from the fixed contacts for breaking the electrical connection between the fixed contacts. The pushbutton switch is then caused to be in an open position.

The base is conglutinated to the insulative housing by glue or epoxy, which would creep into the insulative housing through some gaps defined between the base and the insulative housing. As a result, an operation of the detect switch would be adversely affected.

Hence, an improved pushbutton switch is required to overcome the above-mentioned disadvantages of the related art.

SUMMARY OF THE INVENTION

A primary object of the present invention is to provide a sealed pushbutton switch being ensured of a reliable operation.

To achieve the aforementioned objects, a sealed pushbutton switch comprises an insulative housing defining a cavity, an actuator movably retained in the insulative housing, a base conglutinated to the insulative housing by glue, a plurality of fixed contacts assembled to the base, a spring mounted below the actuator, and a movable contact provided with a contact portion in contact with corresponding fixed contacts, and adapted for pushed by actuator from a first position to a second position relative to the insulative housing along a top-to-bottom direction to insulate the fixed contacts. The base has four slots defined near four sides thereof for retaining glue.

The glue being about to filter into the cavity of the insulative housing is retained in the slots defined near the sides of the base, and therefore would not filter into other portions of the detect switch. Unreliable operation resulted from creeping glue could be avoided.

Other objects, advantages and novel features of the invention will become more apparent from the following detailed description of a preferred embodiment when taken in conjunction with the accompanying drawings.

DETAILED DESCRIPTION OF THE INVENTION

Figure 1:
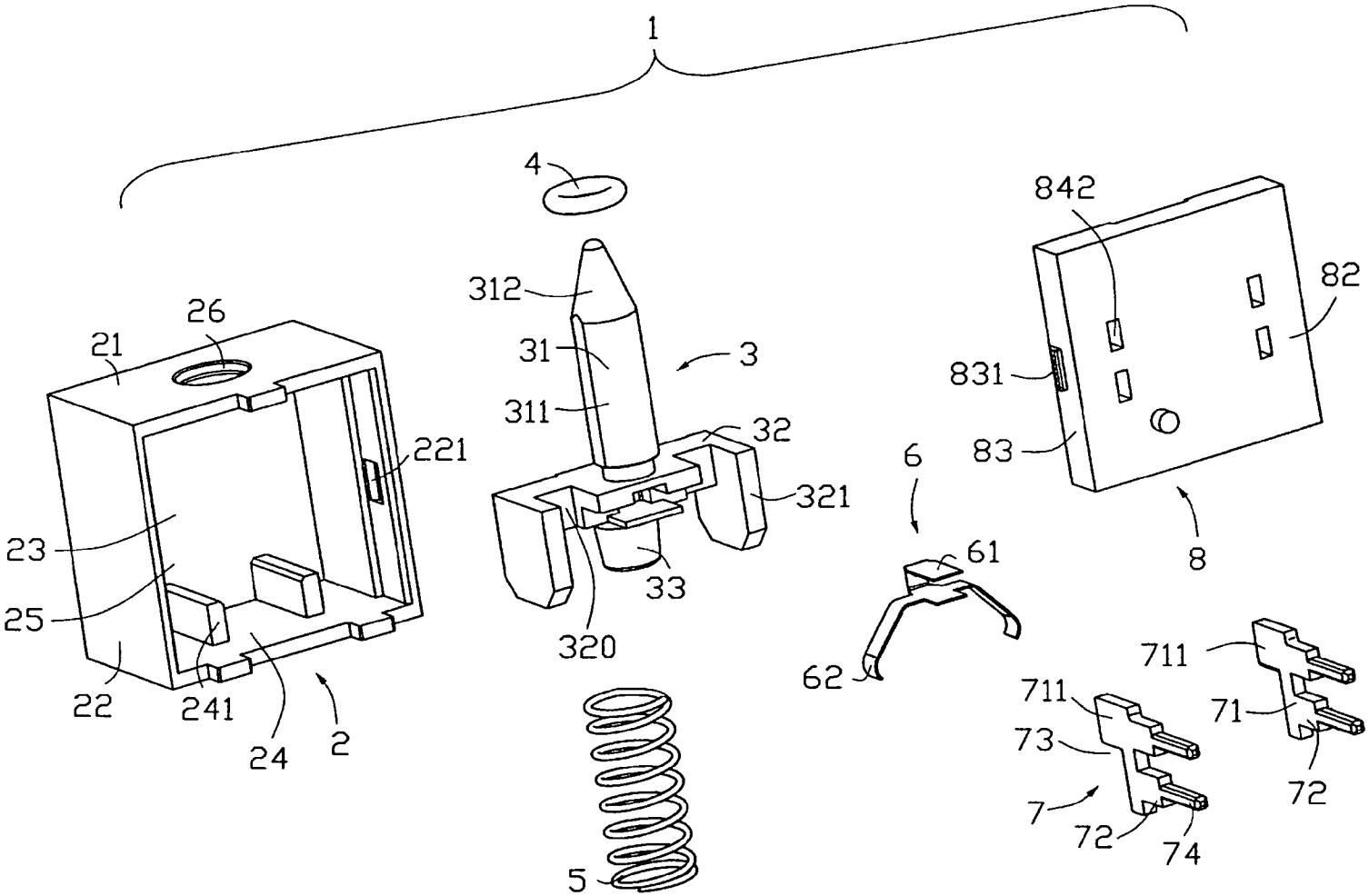
FIG. 1 is an exploded perspective view of a sealed pushbutton switch in accordance with the present invention.

Reference will now be made to the drawing figures to describe the present invention in detail. Referring to FIG. 1, a sealed push button switch 1 in accordance with the preferred embodiment of the present invention comprises an insulative housing 2 defining a cavity 25, an actuator 3 retained in the cavity 25 of the insulative housing 2, a movable contact 6, a seal 4, a coil compression spring 5 bearing against the actuator 3, a base 8 attached to the insulative housing 2, and a pair of fixed contacts 7 mounted on the base 8.

Referring to FIG. 1, the insulative housing 2 is a substantially rectangular case, comprising a front wall 23, a top wall 21, a bottom wall 24 opposite to the top wall 21, a pair of side walls 22 extending rearwardly from the front wall 23 to thereby define the cavity 25 therebetween. The top wall 21 has a circular through hole 26 defined in a central portion thereof. Each side wall 22 has a recess 221 defined in an inner surface thereof. A pair of protrusions 241 are symmetrically formed on the bottom wall 24, each with a free end thereof extending upwardly.

Figure 2:
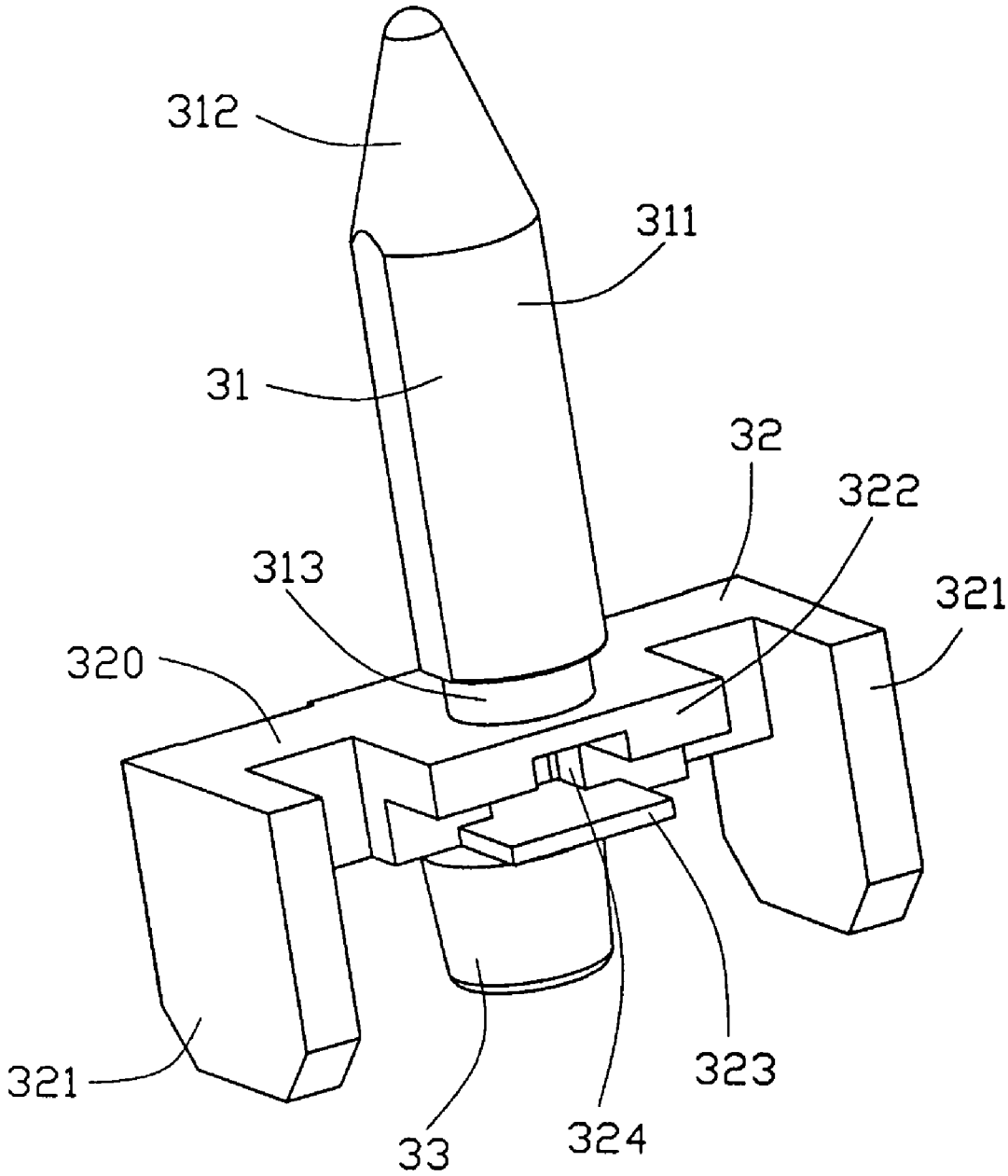
FIG. 2 is a perspective view of an actuator as shown in FIG. 1.

Referring to FIG. 2, the operator 3 comprises a body portion 32 and a button 31 extending upwardly from a top of the body portion 32. The button 31 includes a columnar portion 311, and a guiding portion 312 having a conical shape for facilitating insertion into the through hole 26 during assembly. The button 31 defines therearound an annular groove 313, which is positioned adjacent to the body portion 32. The body portion 32 is provided with a rectangular primary wall 320, a pair of periphery walls 321 perpendicular to opposite sides of the primary wall 320, and a columnar post 33 extending downwardly from the primary wall 320 for engaging the spring 5. A nose portion 322 configured as a flat plane projects rearwardly from a center of an upper portion of the primary wall 320, and is flush with a top surface of the primary wall 320 for upholding the button 31. A slot 324 is defined at a bottom of the nose portion 322 in a longitudinal direction. A tongue portion 323 extends horizontally below the nose portion 322.

Figure 3:
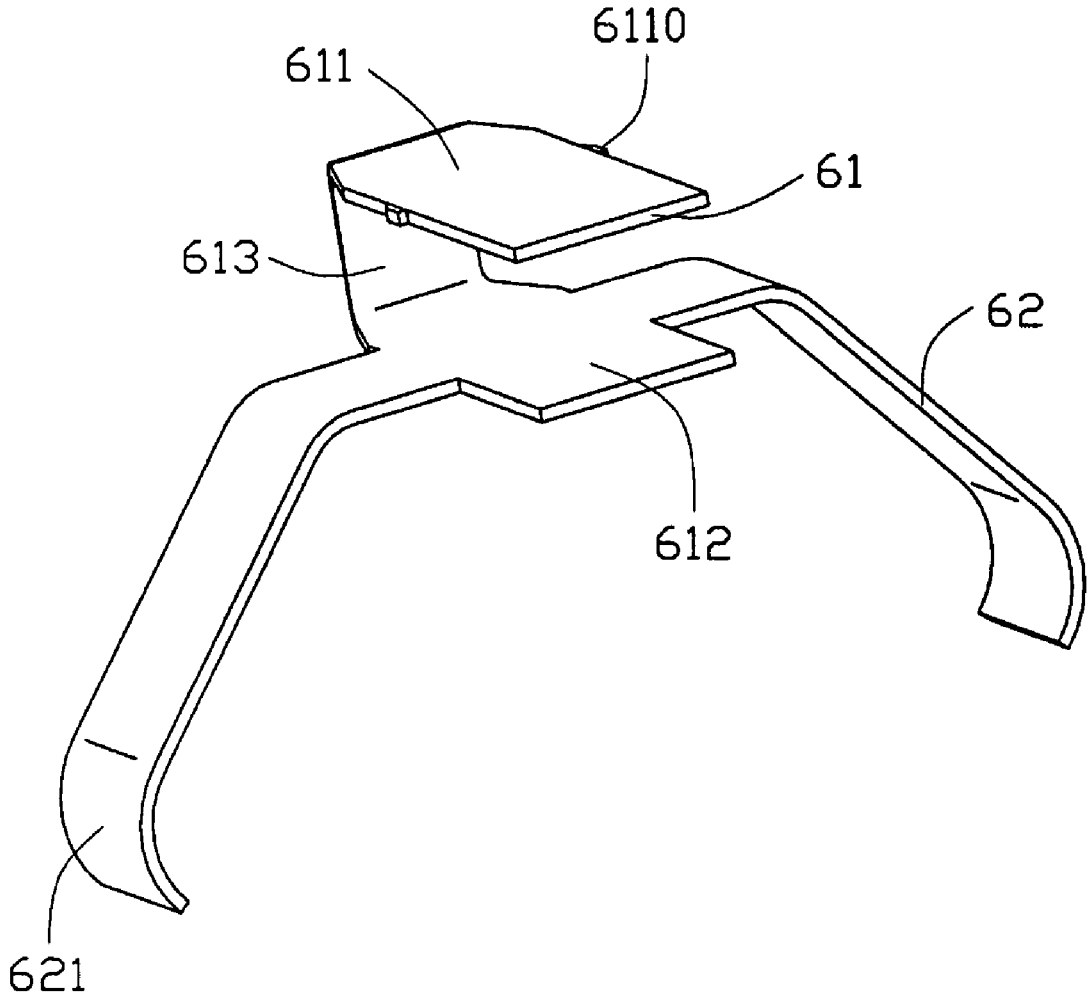
FIG. 3 is a perspective view of a movable contact as shown in FIG. 1.

Referring to FIG. 3, the movable contact 6 is formed by bending a punched metal plate, comprising a retention portion 61 and a pair of elastic beams 62. The retention portion 61 has a primary plate 612, an insertion plate 611 extending parallel to the primary plate 612 and positioned a certain distance above the primary plate 612. The insertion plate 611 has a pair of click projections 6110 formed at opposite edges thereof. A connection plate 613 extends in another direction perpendicular to the extending direction of the primary plate 612 for connecting the insertion plate 611 and primary plate 612 together. The pair of elastic beams 62 extend symmetrically horizontally firstly from a center of opposite sides of the primary plate 612 and then outspread obliquely downwardly. A contact portion 621 having a semi-circular curved surface is formed on a free end of each elastic beam 62.

Referring to FIG. 1, each fixed contact 7 comprises a body portion 71, a pair of soldering portions 74, and a pair of connection portions 72 connecting the corresponding soldering portions 74 to the body portion 71. The body portion 71 is configured as a lying "L", with one end thereof protruding laterally therefrom to form an engaging portion 711. The body portion 71 has an indentation 73 defined beside the engaging portion 711.

Figure 4:
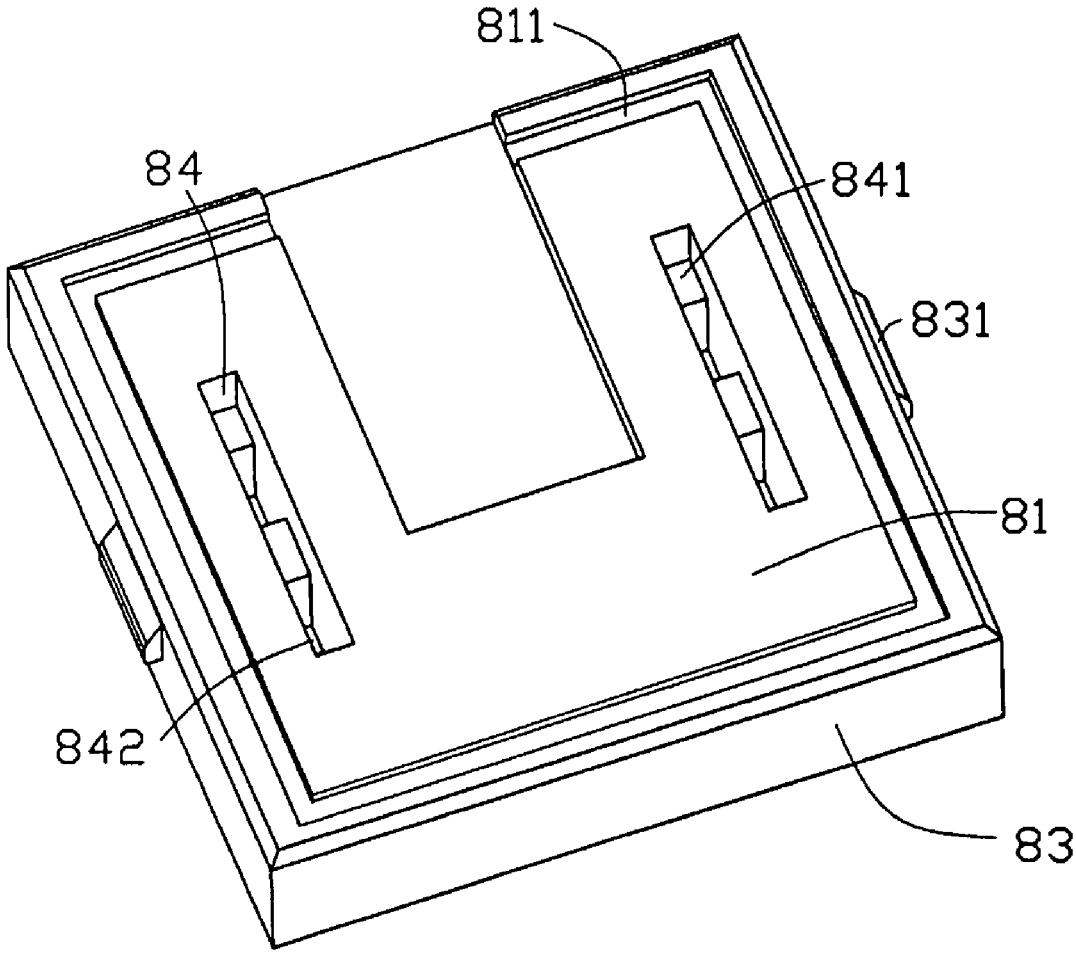
FIG. 4 is a perspective view of a base as shown in FIG. 1.

Referring to FIG. 4, in conjunction with FIG. 1, the base 8 is substantially flat, comprising an inner face 81, an outer face 82 opposite to the inner face 81, four side faces 83 and a pair of tubers 831 formed at two opposite side faces 83 thereof. The inner face 81 has a plurality of slots 811 interconnected as a substantial "C" shape and each defined along a side edge thereof. The inner face 81 has a pair of retaining channels 841 symmetrically defined therein. The outer face 82 defines therein two pairs of insertion channels 142 respectively communicating with corresponding retaining channel 841 for extension of the soldering portions 74 of the fixed contacts 7.

Figure 5:
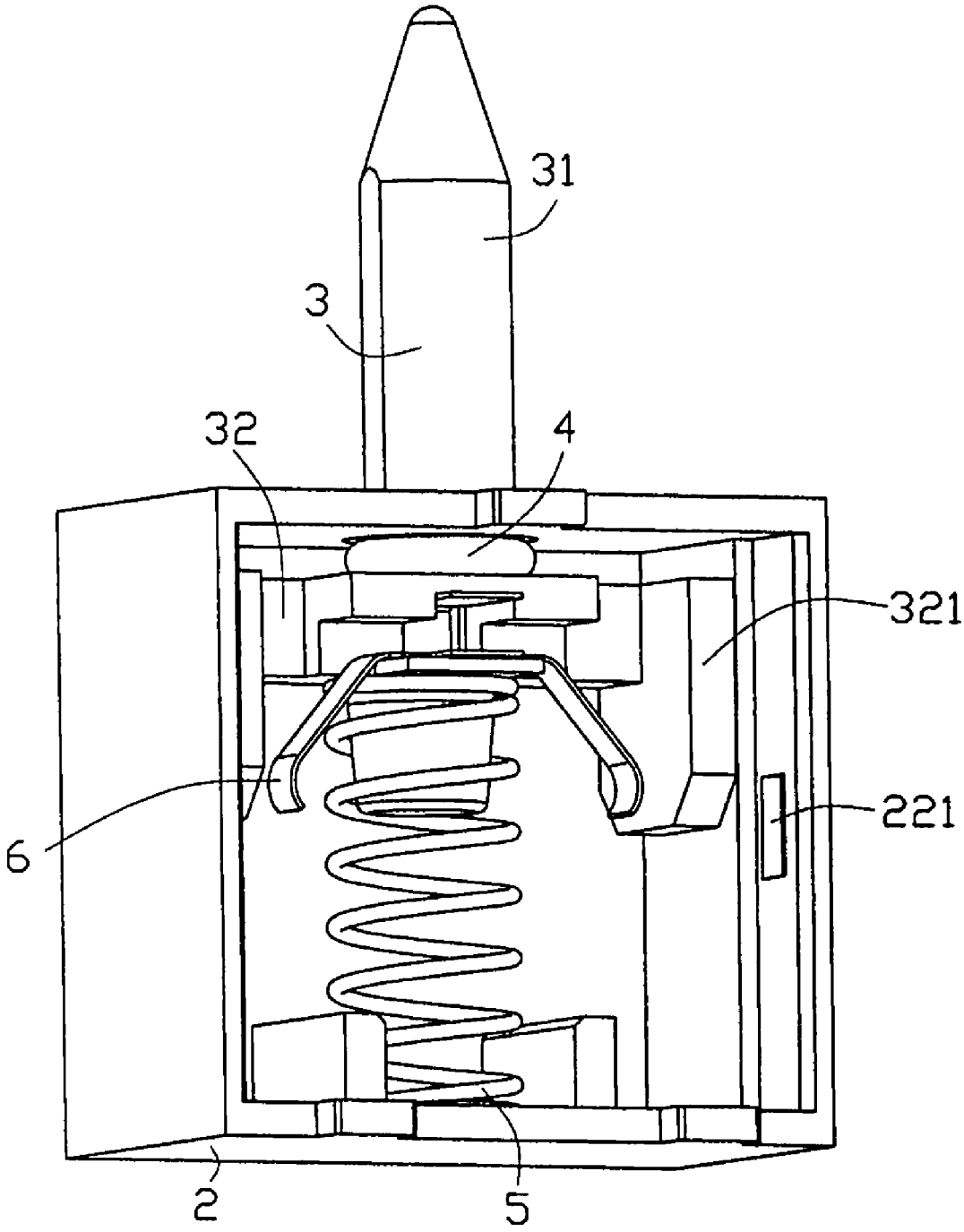
FIG. 5 is an assembled perspective view of the sealed pushbutton switch as shown in FIG. 1, with the base and the fixed contacts being removed.
Figure 6:
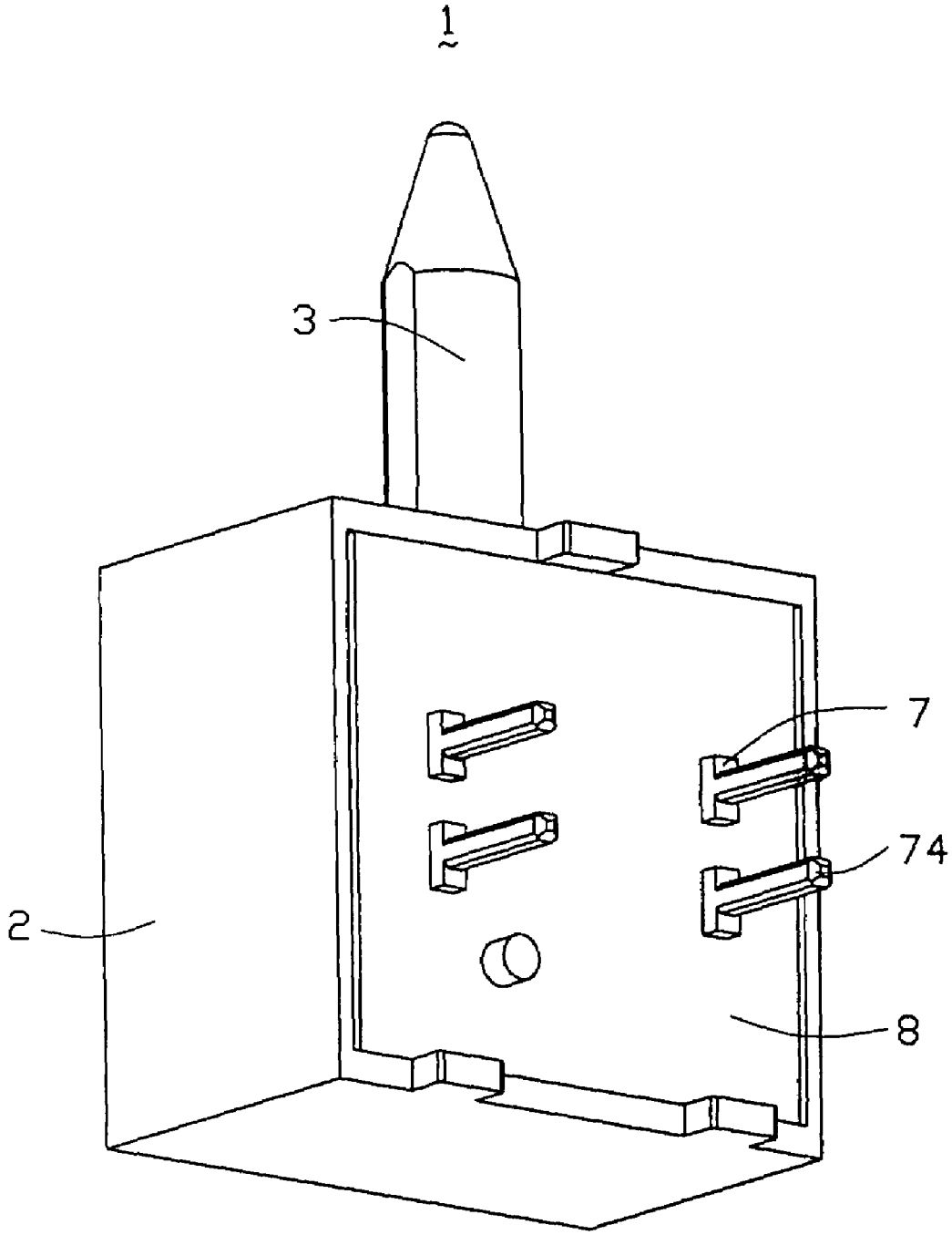
FIG. 6 is an assembled perspective view of the sealed pushbutton switch as shown in FIG. 1.

Referring to FIGS. 5-6, in conjunction with FIG. 1, in assembly of the sealed pushbutton switch 1, the movable contact 6 is fastened to the body portion 32 of the actuator 3 firstly. The retention portion 61 of the movable contact 6 is confined between the nose portion 322 and the tongue portion 323 of the actuator 3, with the insertion plate 611 thereof being inserted into the slot 324 and the click projections 6110 thereof frictionally engaging with the slot 324. The pair of elastic beams 62 are positioned between the pair of periphery walls 321. The spring 5 is assembled to the actuator 3 by encircling around the post 33. Secondly, the actuator 3 together with the movable contact 6 and the spring 5 is received in the cavity 25 of the insulative housing 2, with the button 31 extending outside the top wall 21 through the through hole 26. The seal 4 is then inserted into the annular groove 313 for preventing leaks between the actuator 3 and the insulative housing 2.

Thirdly, the pair of fixed contacts 7 are assembled to the base 8. The body portions 71 of the fixed contacts 7 are respectively partially retained in corresponding retaining channels 841, with engaging portions 711 thereof being exposed on the inner face 11, the connection portions 72 thereof inserted into the corresponding insertion channels 142, and the soldering portions 74 thereof extending outwardly through the insertion channels 142. Finally, the base 8 together with the fixed contacts 7 is attached to a rear portion of the insulative housing 2, with the inner face 81 exposed in the cavity 25. The side faces 83 of the base 8 are conglutinated to the walls 21, 22, 24 of the insulative housing 2 by glue or epoxy. Glues through any gaps (not shown) between the side faces 83 of the base 8 and side edges of the walls 21, 22, 24 of the insulative housing 2 is then confined in the slots 811 of the base 8 and therefore would not creep into other portions of the assembled sealed detect switch 1.

Referring to FIGS. 5 and 7, in a normal position, the spring 5 is located between the actuator 3 and the bottom wall 24 of the insulative housing 2, with a lower portion thereof fixed between the pair of protrusions 241. The pair of elastic beams 62 of the movable contact 6 are positioned between the fixed contacts 7, with the contact portions 621 thereof respectively contacting with the corresponding engaging portions 711. An electrical connection between the fixed contacts 7 is established, via an engagement between the contact portions 621 and the engaging portions 711 of the fixed contacts 7. The sealed pushbutton switch 1 is in the closed position.

In operation, when the button 31 of the actuator 3 is downwardly pushed by exerting an external force, the movable contact 6 is driven to move downwardly together with the actuator 3 to thereby move the contact portions 621 away from the engaging portions 711 and into the indentations 73. The sealed pushbutton switch 1 is caused to be in an electrically opened position, when the electrical connection between the engaging portions 711 of the fixed contacts 7 is broken. At the same time, the spring 5 is compressed. When the external force is removed, the pushbutton switch 1 restores itself to a normally closed position, due to an elastic force provided by the compressed spring 5.

Naturally, the slots 811 could be defined at the side faces 83 of the base 8, or be defined on side edges of the walls 21, 22, 24 of the insulative housing 2, if only be defined near the gaps for containing the glue.

However, the disclosure is illustrative only, changes may be made in detail, especially in matter of shape, size, and arrangement of parts within the principles of the invention.

What is claimed is:

1. A sealed pushbutton switch, comprising:

an insulative housing defining a cavity;

an actuator movably retained in the cavity of the insulative housing;

a base conglutinated to the insulative housing and having a plurality of slots defined near sides thereof for retaining glue;

a plurality of fixed contacts assembled to the base;

a spring compressed between said actuator and the insulative housing; and a movable contact provided with a plurality of contact portions and being movable with the actuator from a first position where the contact portions are in contact with corresponding fixed contacts to a second position where the contact portions disengage from the fixed contacts.

2. The sealed pushbutton switch as claimed in claim 1, wherein said base comprises an inner face exposed in the cavity and an outer face opposite to the inner face, the slots are defined along side edges of the inner face.

3. The sealed pushbutton switch as claimed in claim 2, wherein said base defines therein a plurality of retaining channels, and wherein each fixed contact has a body portion retained in corresponding retaining channel and an engaging portion exposed in the cavity for engaging with corresponding contact portion of said movable contact.

4. The sealed pushbutton switch as claimed in claim 3, wherein said fixed contact has an indentation defined beside the engaging portion.

5. The sealed pushbutton switch as claimed in claim 4, wherein each fixed contact comprises a pair of soldering portions extending outside the base and a pair of connection portions connecting corresponding soldering portions to the body portion, and said base defines a pair of insertion channels communicating with corresponding retaining channels for insertion of the connection portions.

6. The sealed pushbutton switch as claimed in claim 2, wherein said movable contact comprises a retention portion and a pair of outspreading elastic beams, the contact portions being formed on corresponding elastic beams.

7. The sealed pushbutton switch as claimed in claim 6, wherein said actuator comprises a body portion, a button extending upwardly from the body portion, and a post extending downwardly from the body portion with a first end of the spring encircling therearound.

8. The sealed pushbutton switch as claimed in claim 7, wherein said button of the actuator is formed with a column portion and a conical guiding portion.

9. The sealed pushbutton switch as claimed in claim 7, wherein said body portion of the actuator is formed with a primary wall, a pair of periphery walls perpendicular to the primary wall, a nose portion extending rearwardly from an upper portion of the primary wall for upholding the button, and a tongue portion positioned below the nose portion.

10. The sealed pushbutton switch as claimed in claim 9, wherein said retention portion of the movable contact is mounted between the nose portion and the tongue portion of the actuator.

11. The sealed pushbutton switch as claimed in claim 10, further comprising a seal, and wherein said button of the actuator defines therearound an annular groove adjacent to the body portion of the actuator for receiving said seal.

12. The sealed pushbutton switch as claimed in claim 1, wherein said base comprises four side faces defined near the slots.

13. The sealed pushbutton switch as claimed in claim 1, wherein said insulative housing comprises a front wall and a plurality of walls extending rearwardly from the front wall for surrounding the cavity and engaging with the base, the slots being defined at side edges of the walls.

14. The sealed pushbutton switch as claimed in claim 13, wherein said walls comprise a bottom wall, a top wall defining a through hole for partially extension of the actuator, and a pair of opposite side walls defining a pair of recesses for engaging with a pair of tubers formed on the base.

15. The sealed pushbutton switch as claimed in claim 14, wherein said bottom wall is symmetrically formed thereon a pair of protrusions, between which a second end of the spring is confined.

16. A sealed pushbutton switch comprising:

an insulative rectangular housing defining a cavity and a full opening on a first side and a circular through hole in a second side perpendicular to the first side;

a base attached unto the first side and covering the first opening;

a plurality of fixed contacts secured to the base;

an actuator movably retained in the housing; and a movable contact associated with the actuator and movable between a first position where the movable contact is engaged with the fixed contact, and a second position where the movable contact is disengaged from the fixed contact; wherein at least one glue retaining slot is formed along a portion of a periphery of at least one of said base and said housing so as to retain glue therein when said base and said housing are fastened together by said glue.

* * * * *